United States Patent [19]

Gilbert

[11] Patent Number: 4,879,900

[45] **Date of Patent: * Nov. 14, 1989**

[54] HYDRAULIC SYSTEM IN FORMATION TEST TOOLS HAVING A HYDRAULIC PAD PRESSURE PRIORITY SYSTEM AND HIGH SPEED EXTENSION OF THE SETTING PISTONS

[75] Inventor: Gregory N. Gilbert, Houston, Tex.

[73] Assignee: Halliburton Logging Services, Inc., Houston, Tex.

[ * ] Notice: The portion of the term of this patent subsequent to May 24, 2005 has been disclaimed.

[21] Appl. No.: 215,144

[22] Filed: Jul. 5, 1988

[51] Int. Cl.[4] ..... E21B 49/08

[52] U.S. Cl. ..... 73/155; 166/264

[58] Field of Search ..... 73/151, 152, 155; 166/250, 264; 175/40, 50, 59

[56] References Cited

U.S. PATENT DOCUMENTS

| | | | |
|---|---|---|---|
| 3,254,531 | 6/1966 | Briggs, Jr. | 73/155 |
| 3,677,080 | 7/1972 | Hallmark | 73/155 |
| 4,339,948 | 7/1982 | Hallmark | 73/155 |
| 4,513,612 | 4/1985 | Shalek | 73/155 |
| 4,745,802 | 5/1988 | Purfurst | 73/155 |

*Primary Examiner*—Stewart J. Levy
*Assistant Examiner*—Kevin D. O'Shea
*Attorney, Agent, or Firm*—William J. Beard

[57] ABSTRACT

A formation tester is set forth. The device utilizes a snorkel extending from the formation tester to obtain a pressure test and collect samples from a formation of interest. The apparatus includes multiple sample storage containers, thereby cooperating with an equalizing valve to selectively isolate the snorkel from fluid and fluid pressures in the well. A control valve system in a hydraulic circuit operate backup shoes and a snorkel seal until testing is over to assure sealing against well fluid invasion in unconsolidated formation. A speed up sequence for both the backup piston and cylinder arrangement as well as the pad setting piston and snorkel arrangement is illustrated.

12 Claims, 9 Drawing Sheets

HYDRAULIC SYSTEM IN FORMATION TEST TOOLS HAVING A HYDRAULIC PAD PRESSURE PRIORITY SYSTEM AND HIGH SPEED EXTENSION OF THE SETTING PISTONS

BACKGROUND OF THE DISCLOSURE

This disclosure is directed to a formation testing fool and particularly highlights certain methods of operations thereof. After an oil well has been partly drilled and has passed through formations which are thought to be producing formations, one of the next steps in the completion procedure of the well is to perform pressure test on formations penetrated by the oil well. One of the test techniques is to lower a formation testing tool into the oil well. Tests are then performed by making measurements of formation pressure. An exemplary formation testing tool is described in 4,375,164 assigned to the assignee of the present disclosure. As described in that particular disclosure, the tool is adapted to be lowered into the well borehole, supported on an armored logging cable which includes several conductors for providing power to the tool and surface control of the logging tool. The logging cable extends to the surface where it passes over a sheave and is stored by spooling onto a reel or drum. The conductors in the armored logging cable connect from surface control apparatus and power supplies. They also connect to a surface recording system.

One procedure known heretofore is to lower the formation testing tool a specified depth in the well. At that depth, a backup shoe is extended on one side of the formation tester and formation testing apparatus is extended diametrically opposite the backup shoe. The formation testing equipment includes a snorkel system. This involves a surrounding elastomeric sealing pad which isolates an extendible snorkel which penetrates the formation to a specified depth. The snorkel must be isolated from fluid and pressure in the well borehole to be able to measure only the formation. That is, testing of the formation is conducted while isolating the formation tester from fluids and pressures in the well borehole. When the snorkel is extended into the formation, this enables direct fluid communication from the formation into the tool. This permits taking of a sample, and it isolates the sample from invasion of pressure in the well borehole. This permits a sample to be taken free of contamination of other fluids, and it permits pressure tests to be made by means of a pressure sensor to thereby obtain an accurate readout of formation pressure without distorting the data. At the time that a formation test tool is lowered into a well, the possibility of sticking in open hole is always a risk which may result in destruction of the test tool and even the catastrophic loss of the well. It is desirable, therefore, to limit the amount of time that a formation test tool is downhole. It is therefore helpful to speed up operation of the formation test tool.

One limitation is the time required to extend the setting pistons. Through the use of a suitable piston and cylinder arrangement, the above mentioned backup shoe is extended on one side of the borehole so that the formation testing equipment can extend in the diametrically opposite direction. As increase in speed of extension of the backup shoe is helpful, and to that end, the present disclosure sets forth an apparatus which increases setting of the formation test tool. This apparatus incorporates a backup shoe supported by a piston and cylinder for extension, appropriate check valves, a hydraulic circuit connecting with these devices and controlled by two separate three way normally closed hydraulic solenoid valves. Double acting cylinders are utilized so that the backup shoe is extended and retracted under power. The backup pistons and setting piston on which the elastomeric pad is mounted are hydraulically coupled. Therefore, both the backup pistons and setting piston will be extended at an accelerated rate.

An important procedure in execution of pressure test is extending and retracting the snorkel pressure isolated by a surrounding seal. The seal has the form of an elastomeric surface pressed against the formation of interest to isolate borehole fluids and pressures from the formation so that the snorkel can obtain reliable data. This may work for many formations, but in particular, unconsolidated sand formations give difficulty in measurement because it is difficult to perfect a seal against the sand formation. An unconsolidated formation is defined as a sand which washes or erodes with flow. Erosion of sand at or adjacent to the seal face undercuts the seal, and destroys the effective seal accomplished around the snorkel. Even worse, when fluid flow begins through the snorkel, a portion of the unconsolidated formation may flow with the formation fluid. When this happens, the sand erosion at the elastomeric seal around the snorkel may undermine the sidewall of the formation at the snorkel, overcoming sealing isolation of the formation, and thereby permit well fluid to flow into the formation. Unconsolidated sand formations are more likely to produce sand and thus damage the formation shape around the snorkel and the seal when exposed to pressure differentials. The present apparatus incorporates a hydraulic system which maintains a predetermined hydraulic pressure on the supporting elastomeric seal around the seal during sampling to minimize unconsolidated formation sloughing.

With the foregoing in view, the present apparatus is described as an improved formation testing apparatus capable of execution of certain improved procedures. One of the enhanced methods of operation involves speed up extension of the piston and cylinder supporting the backup shoe, wherein formation data can be obtained. Another important procedural advantage of the present invention is the ability of the hydraulically operated control system to sustain predetermined hydraulic pressure acting against the elastomeric seal around the snorkel. More will be noted concerning these and other features of the disclosed apparatus and method of use hereinafter.

DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
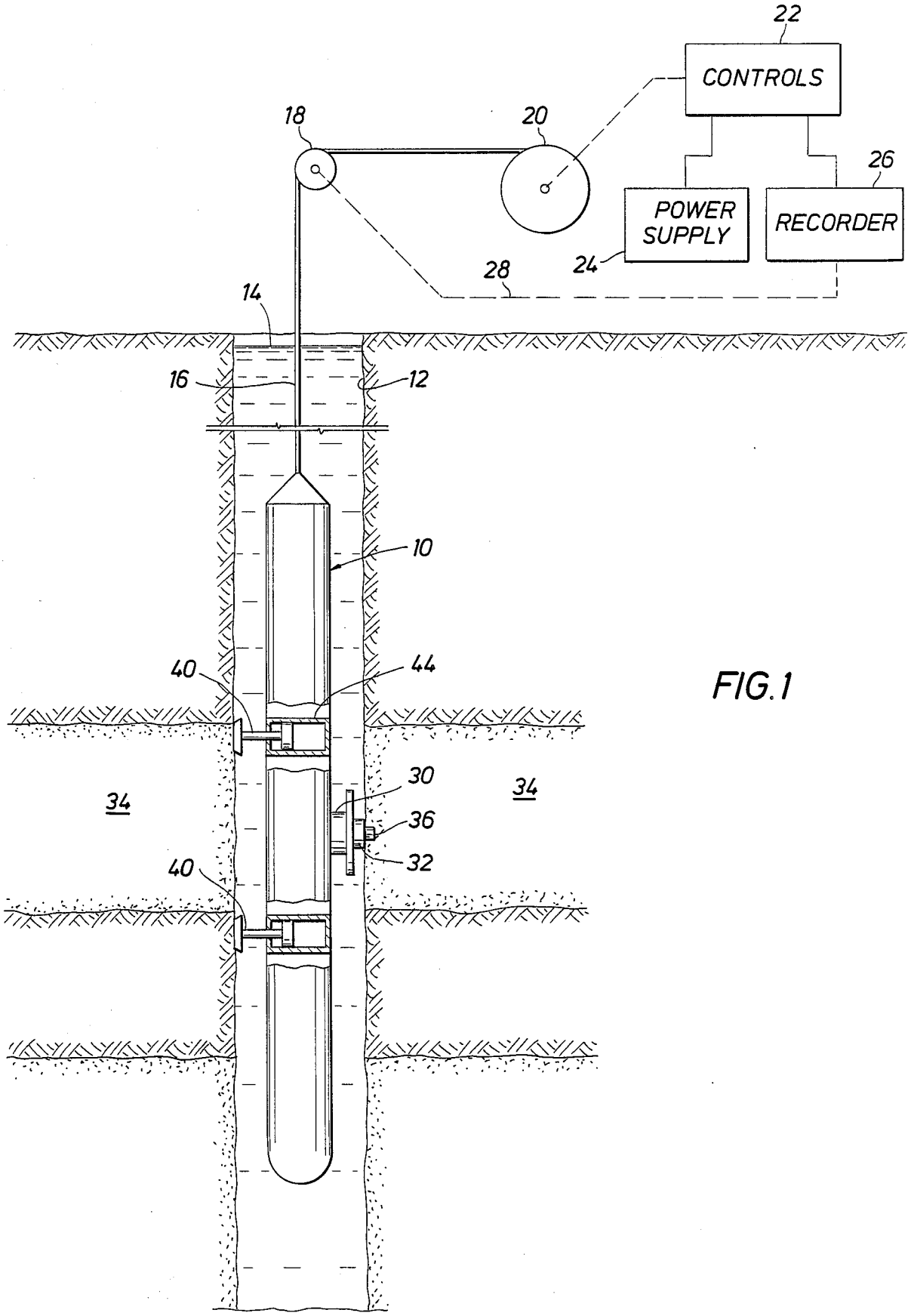
FIG. 1 shows a formation pressure testing tool in accordance with the present disclosure suspended in a well borehole for conducting formation pressure testing.

Attention is directed to FIG. 1 of the drawings where a formation tester 10 is suspended in an open well borehole 12. The well is filled with drilling fluid commonly known as drilling mud indicated at 14. The formation tester is supported on an armored logging cable 16 which extends upwardly to a sheave 18. The cable 16 passes over the sheave and is spooled on a drum 20. The armored logging cable 16 encloses several conductors which connect with a control system 22. The control system 22 also connects with a power supply 24 which furnishes power for operation of the formation tester 10 through the cable 16. Data obtained from the formation tester 10 is supplied through the cable 16 to a recorder system 26. The depth of the formation tester 10 in the well borehole is indicated for recording by electrical or mechanical depth measuring apparatus 28 connected to the sheave 18. It is input to the recorder 26 so that the data obtained is matched with the particular depth of the formation tester 10 in the well borehole 12.

Proceeding further in FIG. 1, the formation tester 10 supports a laterally extended probe 30. The probe is driven by a piston to extend from the tool body. It supports a surrounding ring 32 of elastomeric material. The soft material 32 forms a seal pad which seals against the side wall of the well at the formation 34. Assume that the formation tester 10 aligns with the formation 34 suspected to have formation fluids worth producing. The formation 34 is tested by extending a snorkel 36 into the formation. In operation, the snorkel 36 is isolated to enable it to respond only to fluids within the formation 34. This enables a true and accurate measure of formation pressure to be obtained. It is important to obtain such measurements isolated from drilling fluid intrusion. Normally, the drilling fluid forms a mud cake against the side wall of the drilled hole 12. This mud cake is desirable because it helps isolate the various formations penetrated by the well borehole. When the drilling mud packs against the side wall, there is a tendency for fluid in the drilling mud to penetrate into adjacent formations. The solid particles which make up the drilling mud form a filtrate cake against the formation wall. Liquid from the mud cake invades the adjacent formations. It is necessary for the snorkel 36 to then penetrate through the mud cake and sufficiently deep into the formation 34 through regions altered by the mudcake or filtrate. As will be understood, the snorkel 36 is pushed through the mud cake and deep into the formation.

The probe is ordinarily extended in the manner shown in FIG. 1. To assure alignment and positioning, double acting backup pistons extend backup shoes 40 shown in FIG. 1. Ideally, there two backup shoes. They are vertically aligned along the tool body and are diametrically opposite the seal pad 32 and snorkel. Preferably, one or more is located above the snorkel and a similar arrangement is below the snorkel. This fixes the tool body at a particular location in the well borehole and assists in securing the tool body during formation testing operation.

Tool operation involves use of the snorkel 36 to fill various pressure vessels within the formation tester 10. The timed operation of the snorkel to fill the sample chambers in the formation tester 10 will be described in detail hereinafter. Some detail must be given to enhance the understanding and begins with the hydraulic system generally indicated at 50.

FORMATION TESTER HYDRAULIC SYSTEM 50

Figure 2:
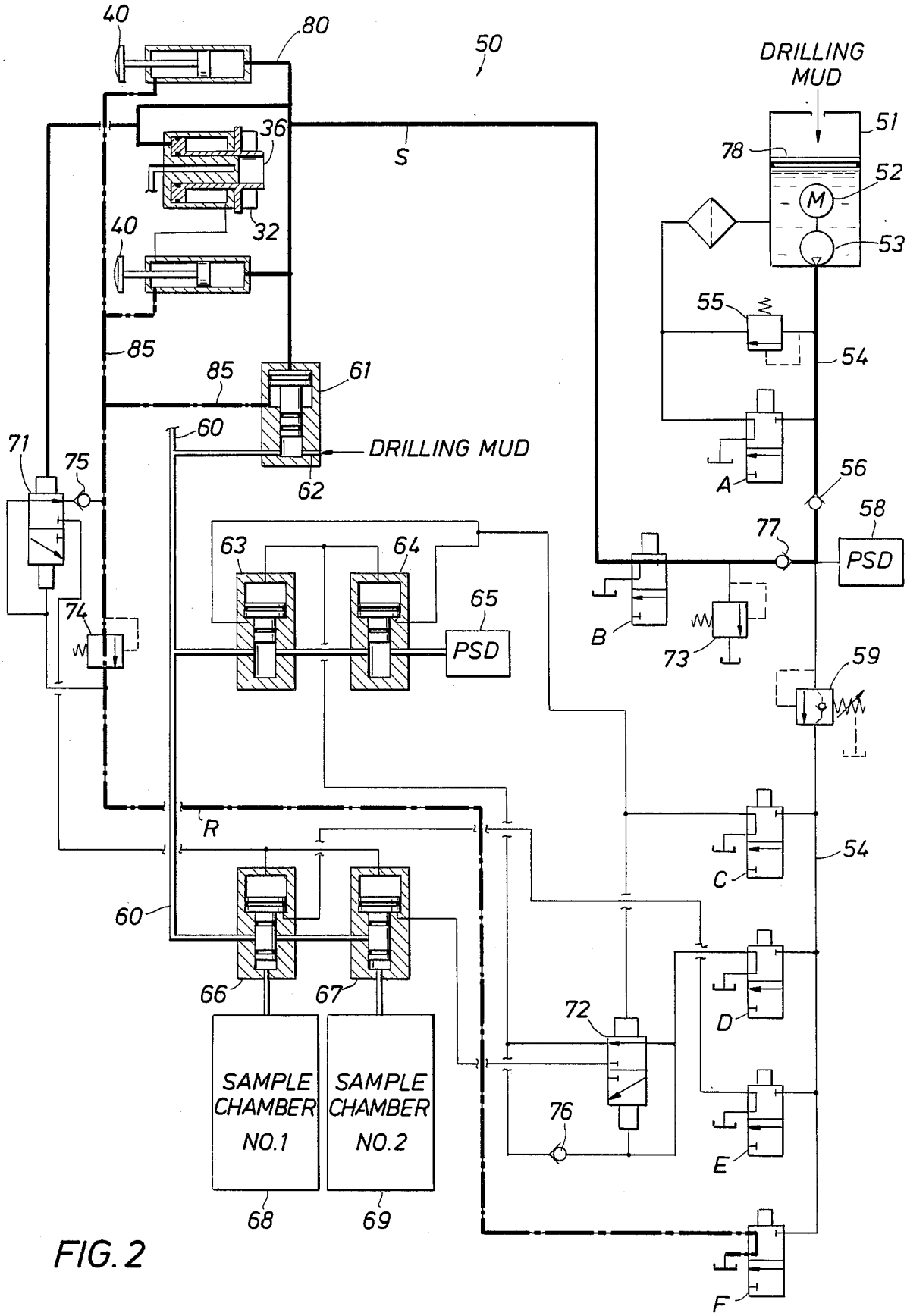
FIGS. 2 through 8 are similar hydraulic schematics showing certain lines pressurized to illustrate certain operational steps.

In FIG. 2 of the drawings, the hydraulic system 50 is shown in detail. The components will be described first and the operation of this system will be set forth in detail later. A chamber 51 establishes a particular hydrostatic pressure level. The chamber is loaded from the exterior pressure in the borehole. A pressure compensating piston 78 provides a barrier between the borehole fluids and the hydraulic fluid in the pressure compensated reservoir. A motor 52 drives a pump 53 which delivers hydraulic fluid at some pressure greater than the pressure of the drilling fluid. It will be understood that the formation tester 10 is operated at different depths in different weights of drilling mud and is therefore exposed to a highly variable external pressure. The hydraulic system 50 operates at a pressure which is equal to the external or mud pressure plus an increment sufficiently higher to assure operation. It connects with an outlet line 54 which delivers oil at an elevated pressure. A relief valve 55 dumps to sump in the event that pressure is excessive. A check valve 56 in the line 54 prevents back flow. The outlet line 54 is connected with a pressure detector 58 which forms an indication of instantaneous pressure. A serial priority valve 59 is also included to isolate certain control valves in the event the hydraulic system is unable to sufficiently supply all of the control valves if there is a momentary high demand for hydraulic flow.

The hydraulic control system 50 incorporates several similar, or even identical control valves. They all have similar construction. They are identified by the letters A–F. Preferably, the valves A–F are all solenoid operated. In the deactivated position they all connect to sump. Connection of each solenoid valve to the sump in the deactivated position has two benefits, (1) to relieve pressure on a component when it is no longer being operated; and (2) to provide a fail-safe method of relieving hydraulic pressure on operated components in the event of power failure. This feature eliminates the need for an emergency dump valve, as used by other systems. When the solenoid is operated, a connected path through the respective control valves is then opened.

Going now to additional components in FIG. 2, the backup shoes 40 are also spaced on both sides of the snorkel 36. The snorkel is able to receive formation fluid into the snorkel from the formation and through the sample line 60. The sample line 60 runs from the snorkel 36 to other components as will be described. The sample line includes a branch which connects with the equalizing valve 61, a double acting valve. This valve includes a port 62 which opens to the exterior of the formation tester 10 to be exposed to drilling mud. The external mud pressure is introduced by the port 62 to equalize across the snorkel and seal pad 32 to avoid sticking of the formation tester 10. The equalizing valve 61 selectively opens the port 62 to connect the port 62 to the sample line 60.

The sample line 60 also connects with drawdown chambers 63 and 64 including double acting pistons. The sample line 60 also connects to a pressure detector 65 to measure the pressure in the sample line.

The sample line 60 additionally connects with first and second storage chamber valves 66 and 67. The two storage valves in turn connect with first and second storage chambers 68 and 69. They are sized to hold samples delivered through the sample line 60 of a specified volume.

In general terms, the apparatus for handling the samples actually obtained has now been described. However, the system 50 includes additional apparatus which should be identified. There are two additional valves identified by the numerals 71 and 72. The system also includes pressure relief valves 73 and 74. The system 50 includes check valves 75, 76, and 77. For purposes of easy identification, selected hydraulic fluid lines need to be described. The numeral 80 identifies the setting line. That connects from the control valve B to the equalizing valve 61, the backup pistons 40, and the valve 71. The fluid line 85 is the retract line, and it connects to the equalizing valve 61, backup pistons 40, and control valve F.

Operation of the hydraulic system 50 shown in FIG. 2 is enhanced by review of additional drawings. The same structure 50 is shown in all these drawings. However, the additional views of the system 50 are highlighted to bring emphasis to the system 50 operation. The views following FIG. 2 can be considered in a sequence, but the sequence may be varied for a number of reasons. The additional views show fluid flow routes during operation. For example, hydraulic fluid under pressure is delivered through the setting line 80 in FIG. 2. This line has been graphically highlighted as a heavy line to bring this fact out. This flow is accomplished by switching the control valve B to deliver oil under pressure to close the equalizing valve 61 and to set the backup shoes 40. Also, the pressure on the setting line 80 is delivered to the valve 71 to operate that valve. The setting line 80 powers the double acting pistons 40 to force oil into the retraction line 85. FIG. 2 shows the line 85 highlighted to illustrate retraction fluid flow path. This oil is returned to sump through the control valve F. When this operation is completed, the equalizing valve 61 has been closed and the pistons 40 have been extended. In FIG. 2, the lines 80 and 85 are marked to distinguish the high pressure fluid delivered through the line 80 and fluid returned through the retraction line 85.

Figure 3:
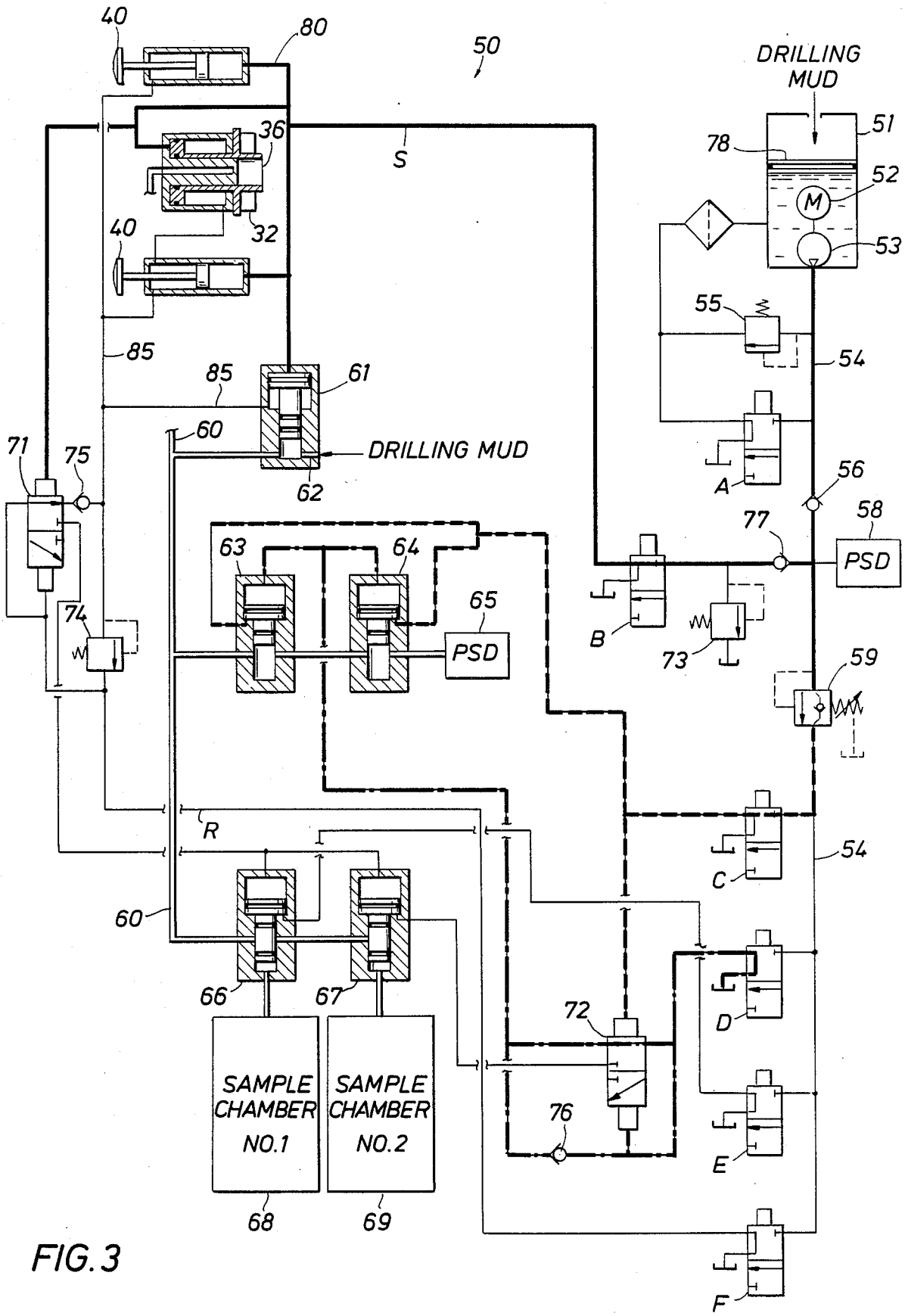

FIG. 2 should be contrasted with FIG. 3 involved with opening pretest chambers 63 and 64. Recall that they are connected to the sample line 60. When the tool is placed in the well, they are closed but filling is accomplished by moving the pistons upwardly, thereby expanding the chamber and creating a suction which draws sample in. Heretofore, when sample for pretest purposes was drawn from the sample line, it would flow from the snorkel into the sample line 60. Prior to opening the pretest chambers 63 and 64, the snorkel is extended in the conventional fashion, a step not illustrated but readily understood. A pretest sample is pulled through the snorkel into the sample line. Operation of the pistons for filling pretest chambers 63 and 64 creates a vacuum which is coupled through the sample line to the tip of the snorkel into the formation. When this occurs, the unconsolidated formation may slough sand as well as fluid. The sand will perhaps be drawn into the sample line 60, thereby structurally damaging the formation. When formation damage occurs, the region of the formation around the snorkel tip may collapse. If the elastomeric pad 32 is at a fixed location, sand movement adjacent the pad may erode the formation so that fluid from the borehole readily flows past the pad, invading the formation, and distorting the data obtained through the snorkel. It is possible for channeling into the formation to occur, washing away enough of a pathway so that drilling mud flows from the borehole into the snorkel, excluding formation fluid completely. To avoid this, FIGS. 2 and 3 show a contrast where the pretest chamber 63 and 64 are operated with the pressure held high on the setting line 80. Snorkel operation steps have been omitted for ease of presentation of the contrast in FIGS. 2 and 3. FIG. 3 therefore shows operation of the valve C through the priority valve 59 so that hydraulic fluid is applied for opening of the pretest chambers. While this may momentarily pull a vacuum around the tip, pressure is sustained on the backup shoes 40 and on the snorkel seal pad 32 so that drilling mud does not flow into the region of the snorkel and thereby exclude formation fluid.

As shown in the transition from FIG. 2 to FIG. 3, the pretest step applies high pressure to the pretest chambers 63 and 64 while simultaneously holding high pressure on the line 80 and in particular to the backup shoes 40 holding them in the extended position. This sustains pad pressure around the snorkel and reduces markedly the tendency of the unconsolidated formation to slough off, and thereby assures a more reliable test.

Perhaps the best way to appreciate the benefits of the present system is to review FIGS. 2–8 inclusive and to note the sequence of operation and in particular the application of pump pressure to the backup shoes 40 to hold them in the extended position along with pressurization of the elastomeric seal 32. Thus, FIG. 2 shows in accented line application of pump pressure to the described components and in particular to the double acting cylinders which extend the backup shoes and the snorkel 36. This fastens the formation test tool 10 properly in the borehole and provides wall loading against the formation to prevent sloughing and undercutting. The accented flow lines in FIG. 2 make this clear, namely that pressure is sustained so that continual loading is applied. By contrast, FIG. 3 continues the pressure application through the control valve B onto the line 80, thereby assuring that the backup shoes and snorkel pad are pressed firmly against the formation; high pressure is newly applied through the control valve C as indicated by the accented lines extending to the pretest chambers 63 and 64. The return to sump from the means 63 and 64 is shown in accented line also, the path to sump extending through the control valve D. Sometime later, the first sample chamber 68 is filled, this being achieved by opening the control valve 66 connected to the sample line, and sample is thus input to the sample chamber 68. This is achieved by operation of the control valve E. This produces a return flow to sump through the control valve F, all as shown by the accented lines in FIG. 4. If need be, the sequence of operation shown in FIG. 4 can then be reversed to close the sample chamber 68.

Figure 5:
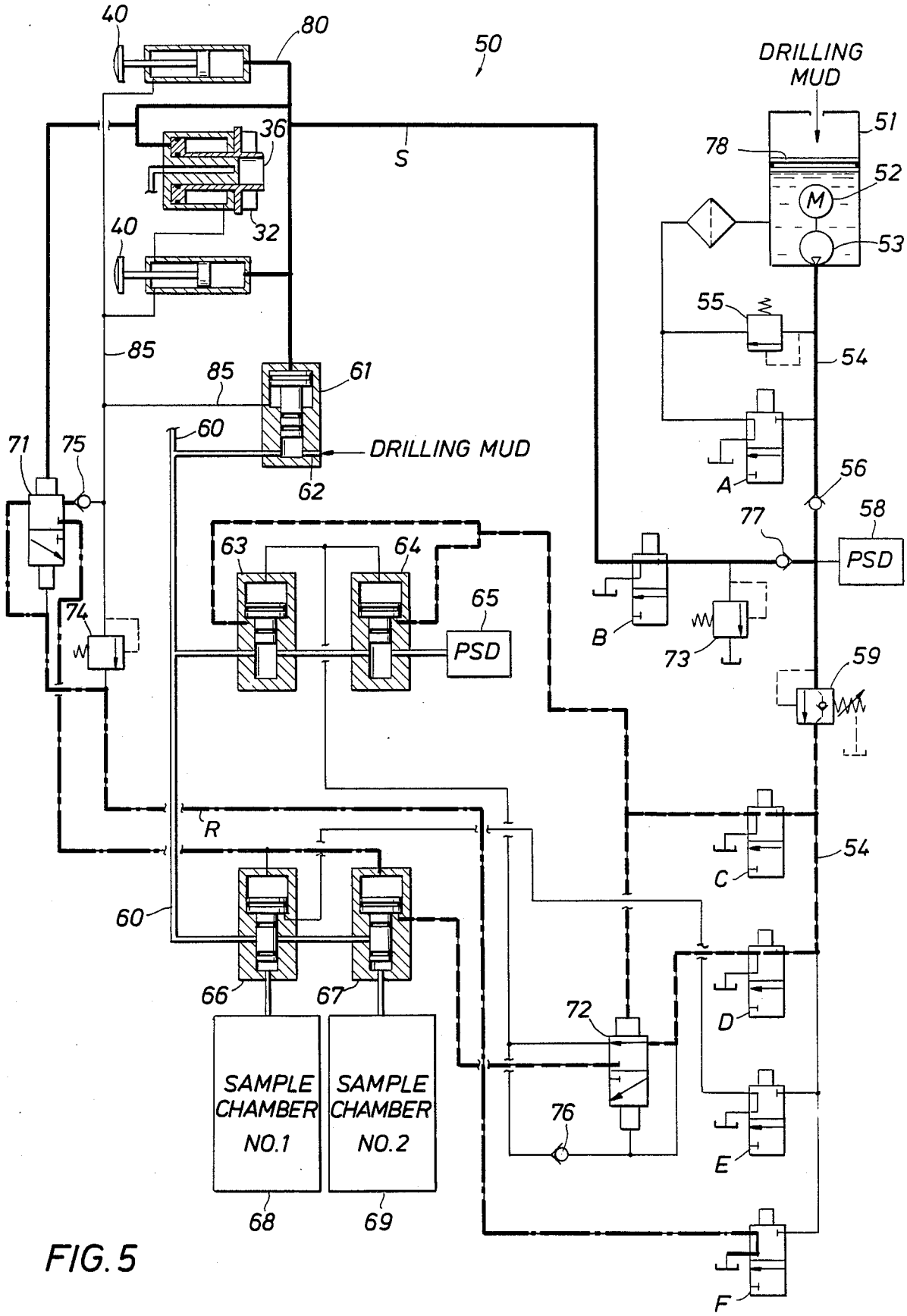

FIG. 5 shows a sequence for filling the second sample chamber 69 under control of the valve 67. This is accomplished through the control valve D which is switched to provide high pressure fluid through the valve 72 and to the chamber control valve 67. Fluid return through the valve 71 and line 80 is utilized to return the fluid to sump through the control valve F. The foregoing shows the sequence in which the second sample chamber is opened, and it can be closed by reversing the same sequence.

Figure 6:
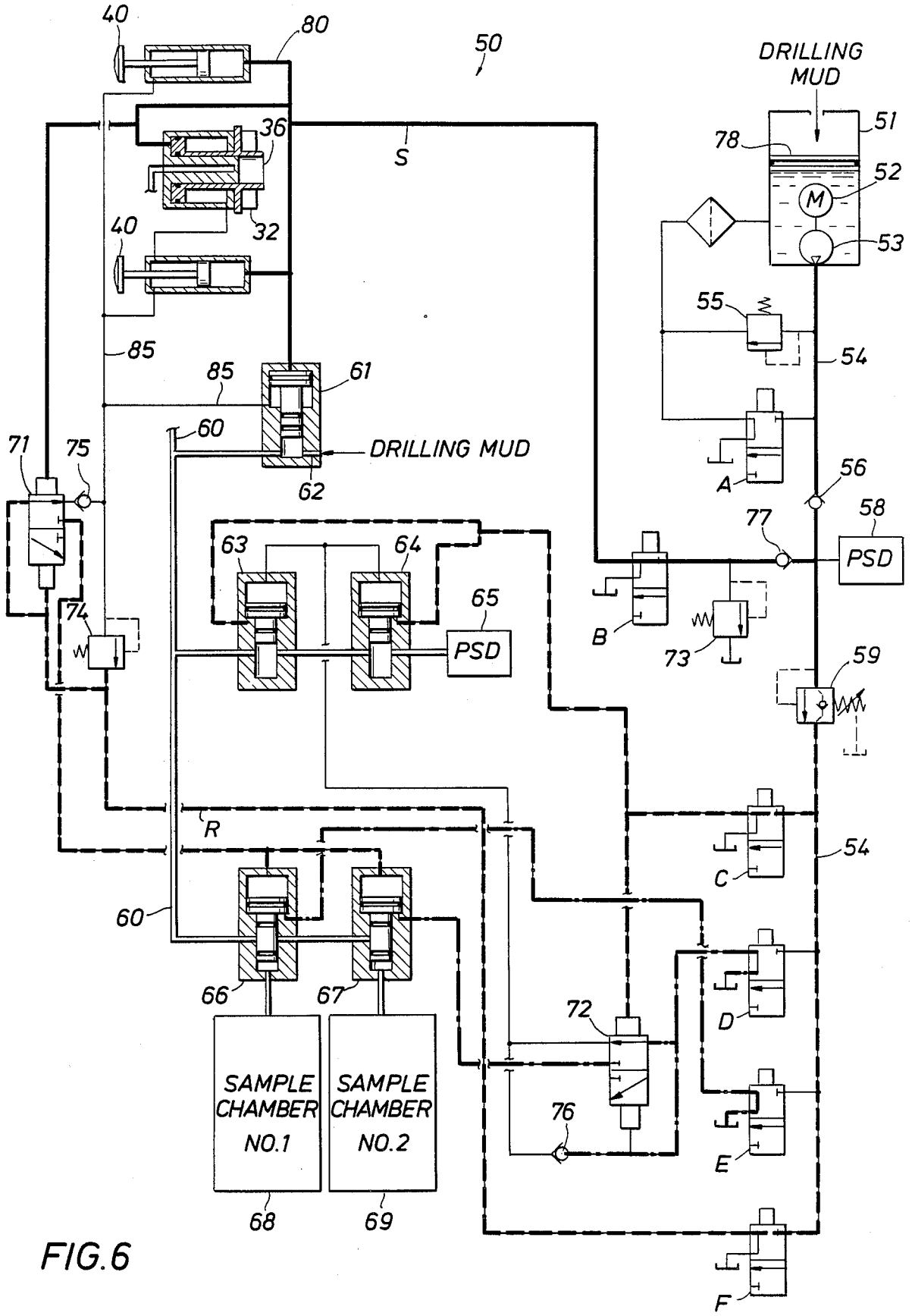

FIG. 6 shows the closing sequence wherein both sample chambers can be closed through high pressure applied to the control valve F, the valve 71 and to the chamber valves 66 and 67. The sequence in FIG. 6 is implemented after the operation shown in FIGS. 4 and 5, or after either of the chambers has been filled as noted above.

Figure 7:
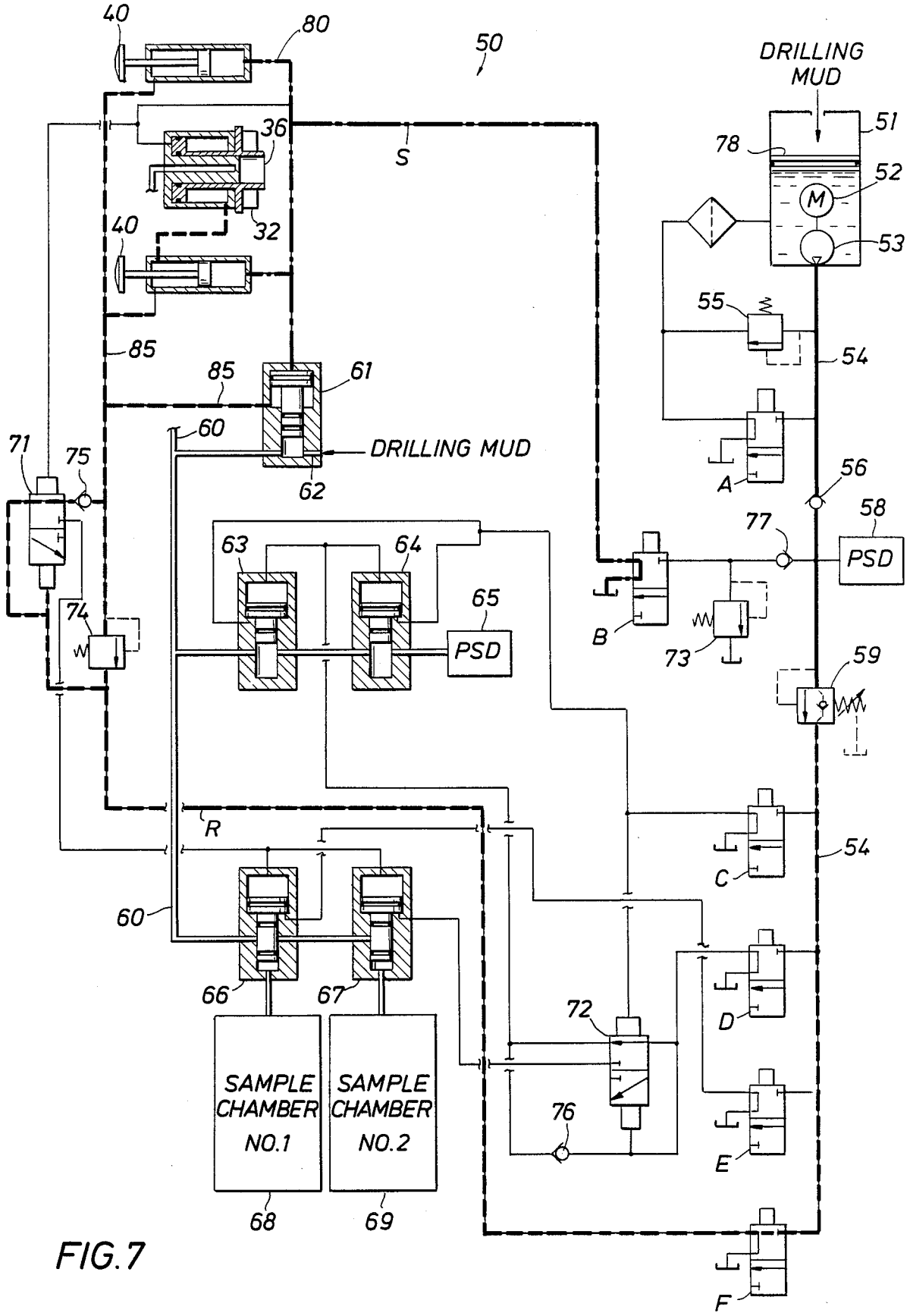
Figure 8:
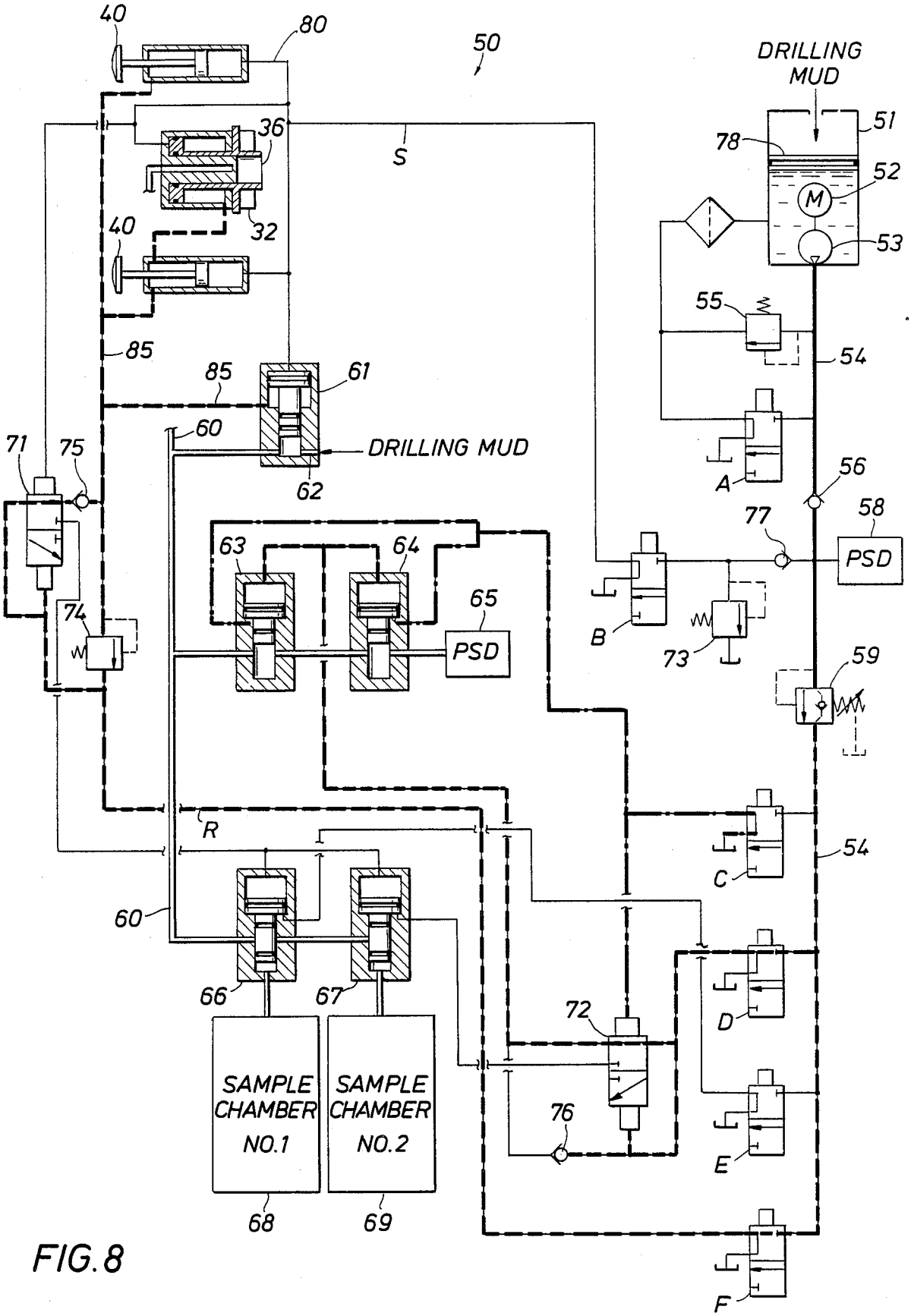

FIG. 7 shows retraction of the backup shoes 40 and the snorkel 36. The control valve F is actuated to apply pressure to the valve 71 which applies pressure through the check valve 75 to the retraction line 85. This powers the cylinders connected to the backup shoes 40. Also, the snorkel is retracted. FIG. 8 shows the sequence in which high pressure hydraulic fluid is applied to the control valves D and F to close off the pretest chambers 63 and 64.

To summarize various operations as shown above and to provide an example of various operational steps the following table summarizes operations. It should be kept in mind that the precise sequence in which these operations are performed can be varied. Accordingly, the table below is an exemplary operation. FIGS. 2 through 8 do not show all details of the snorkel pad setting piston arrangement. The setting line 80 applies fluid to the setting piston on which the elastomeric pad 32 is mounted. The snorkel tube 36 extends through the pad and setting piston in a telescoping fashion.

Figure 4:
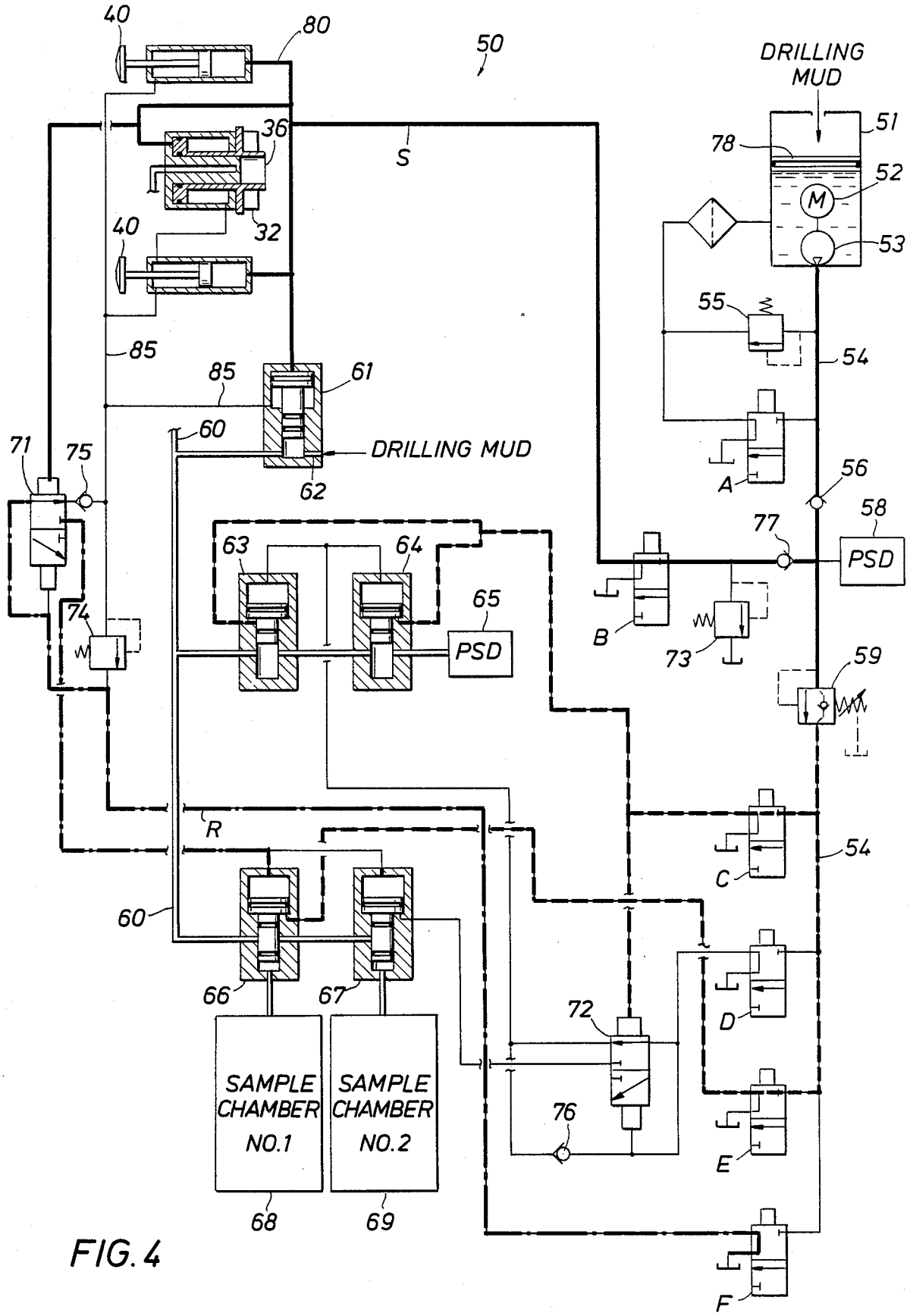

| CONTROL VALVE | OPERATION | FIGURE |
|---|---|---|
| Open B & Deactuate F for Sump Return | Extend Backup Shoe 40<br>Close Equalizer Valve 61<br>Extend Snorkel 36 | FIG. 2 |
| Hold B Open, Open C, Deactuate D for Sump Return | Fill Pretest Chambers 63 and 64 | FIG. 3 |
| Hold B & C Open, Open E & Deactuate F for Sump Return | Fill Sample Chamber 68 | FIG. 4 |
| Hold B & C Open, Open D & Deactuate F for Sump Return | Fill Sample Chamber 69 | FIG. 5 |
| Hold B & C Open, Open F & Deactuate D & E for Sump Return | Close Sample Chambers 68 & 69 | FIG. 6 |
| Open F & Deactuate B for Sump Return | Open Equalizer 61,<br>Retract Snorkel 36,<br>Retract Backups 40 | FIG. 7 |
| Open F & D, Deactuate C for Sump Return | Close Pretest Chambers | FIG. 8 |

In the foregoing table, the phrase, "Deactuate F for Sump Return" refers to the use of the control valve F whereby flow in the line 85 is directed to the control valve F and then to the sump. It is not open in the same sense that the valve B is open, see FIG. 2 as an example. The sequence shown above is not the only sequence of operation. Through various signals applied to the control valves A–F, other sequences can be dictated.

As will be understood, the foregoing procedure is not the only sequence of operation. Through the appropriate operation of control valves A–F, other sequences of operation can be obtained. The control valves A–F are either operated independently, or programmed in the computer for a sequence of operation, or operations.

In use, the present apparatus particularly enables the execution of formation testing with the means 10 to obtain isolated pressure in the indications. The isolation sequence is particularly helpful to remove any bias which may arise in obtaining formation pressure measurements. The measurements from the formations are ideally obtained free of bias. The bias, as mentioned before, may arise from filtration from the mudcake of drilling fluids, and may also arise as a result of snorkel intrusion into the formation. It is helpful to have static formation measurements both before and after sample draw.

SPEEDUP SYSTEM

Figure 9:
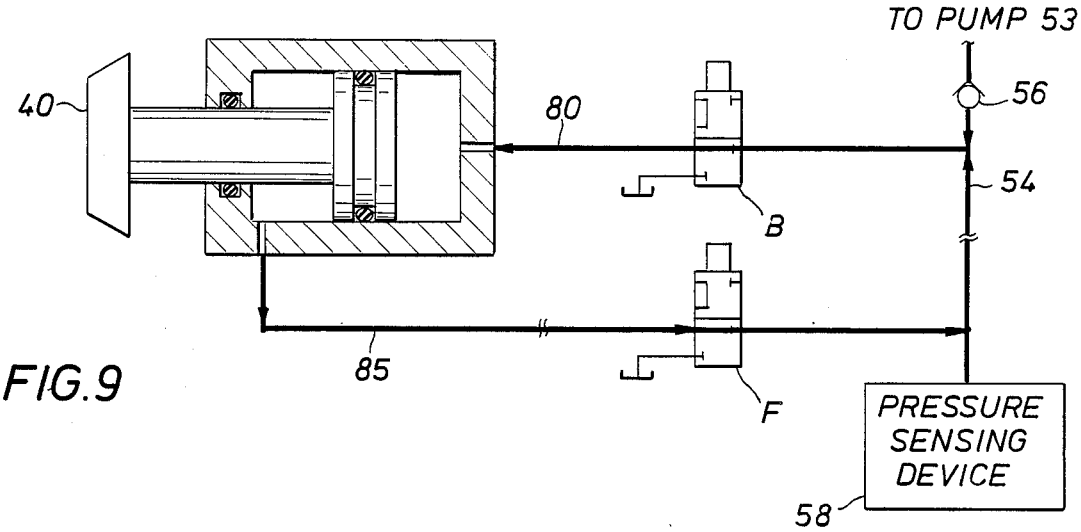
FIGS. 9 through 11 are similar partial hydraulic schematics showing certain lines pressurized to illustrate certain positions of the backup shoes during extension and retraction.

FIG. 9 shows only a portion of the tool hydraulic system from FIG. 2. The portion primarily includes the double acting hydraulic piston and cylinder operating the backup shoe 40, and control valves B and F. The pressure sensing device 58 is also specifically illustrated. Both backup piston and cylinder arrangements and the pad setting piston and snorkel are hydraulically coupled together. That is, the line 80 is the common set line and the line 85 is the common retract line. Other components in the circuit have been omitted to enhance clarity and accomplish the contrast necessary in FIG. 9. Briefly, the double acting arrangement incorporates a piston having two faces. The line 80 applies pressure to extend the piston, acting on the large face, while the opposite face of the piston is smaller in area. The small face is exposed to the line 85.

FIG. 9 shows the flow path for fluid to extend the backup shoe. Briefly, fluid flow from the pump 53 passes through the check valve 56 and the control valve B. The line 80 delivers fluid to the cylinder, causing the piston to extend. When this occurs, fluid is pumped out of the cylinder into the line 85. This fluid is routed through the control valve F into the line 54. It is not routed to sump; fluid flow into the line 54 can escape only through the control valve B, thereby enhancing fluid flow during this setting step. The pressure sensing device 58 monitors the fluid pressure in the line 54 to assure maintaining the proper operating pressures.

Figure 10:
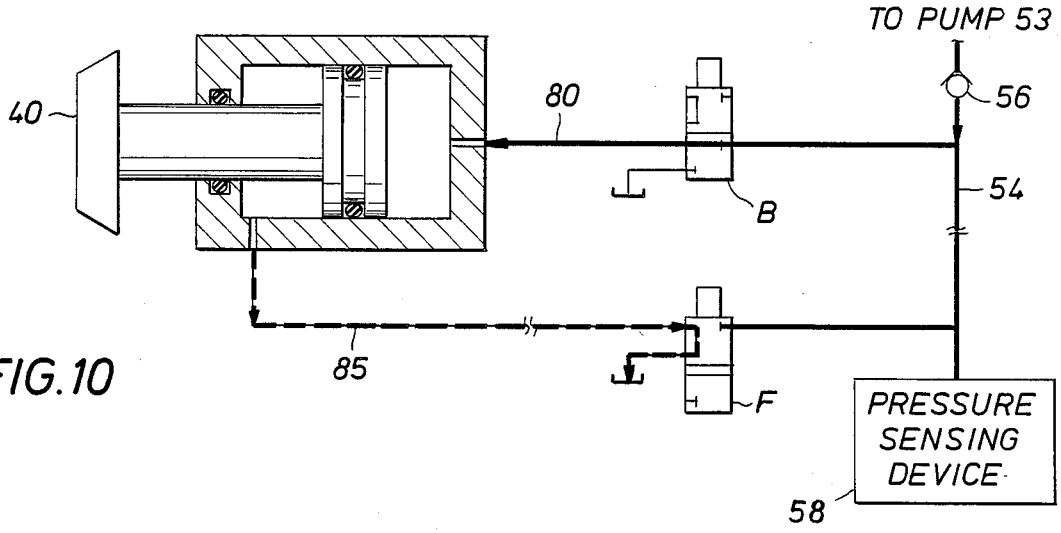
Figure 11:
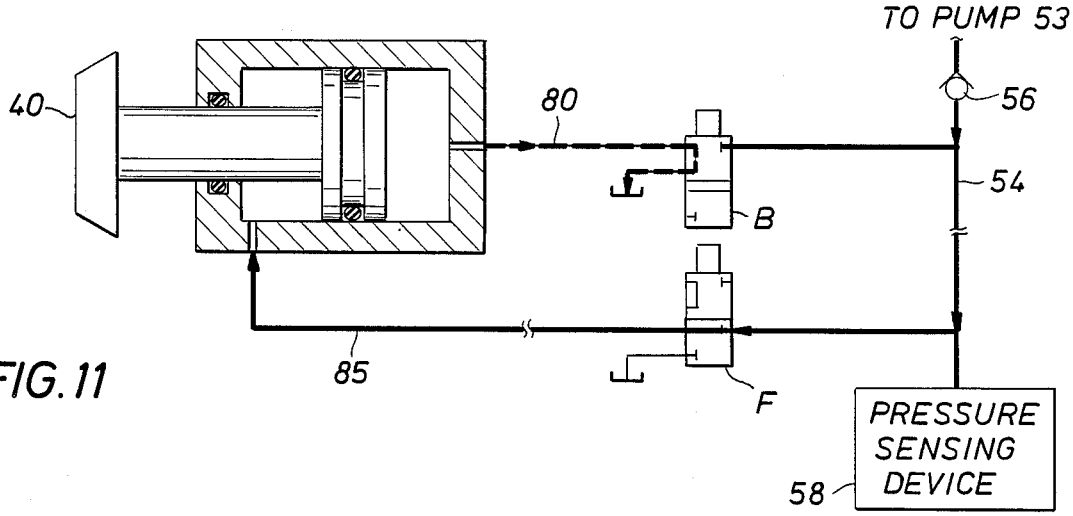

FIG. 10 shows the same apparatus shown in FIG. 9 where the control valve F has been switched to deliver fluid to the sump. This normally occurs after the piston has traveled to the extremity of movement. Pressure is then sustained through the control valve B while flow through the line 85 substantially terminated, and any minimal flow as might occur is returned to sump. This is the condition which is held throughout the extended operation of the backup shoe 40 as discussed above. FIG. 10 should be contrasted with FIG. 11 of the drawings. There, the fluid flow completes retraction. Briefly, the control valve B is deactuated to sump, and closed to flow from the line 54. The control valve F is operated so that high pressure is applied through the line 85 acting on the piston, causing retraction of the backup shoe 40. The sequence shown in FIGS. 9, 10 and 11 appears remarkably simple but it is nevertheless extraordinarily beneficial. Moreover, it is accomplished with the hydraulic system 50 as shown in FIG. 2, with primary focus being directed to control valves B and F. Moreover, the pressure is sustained whereby the backup shoe is extended continuously so that a firm grip is achieved and held in the borehole against the sidewall. The backup shoes are extended rapidly and are retracted. One feature of this arrangement is the area differential involved in extension versus retraction. Extension with the feedback shown in FIG. 9 is accomplished more rapidly than heretofore. Retraction is achieved rapidly, thereby enabling tool movement without pressure differential sticking. Moreover, the benefits of the high speed extension of the backup shoe can be obtained without modification of the hydraulic system for the tool.

While the foregoing is directed to the preferred embodiment, the scope thereof is determined by the claims which follow.

What is claimed is:

1. A method of preparing to make measurements useful in determining the permeability of earth formations traversing a well borehole, comprising the steps of:

(a) initially positioning a formation testing tool in the well borehole opposite the formation to be tested;
(b) sealing a pad against the formation;
(c) extending a snorkel through the sealed pad into the formation to enable testing;
(d) connecting an equalizing valve between the snorkel and the well borehole;
(e) controllably isolating and connecting through the equalizing valve pressure prevailing in the well borehole to the snorkel to establish a direct fluid flow path for communication with the formation to be tested;
(f) drawing a fluid sample from the formation sufficient to substantially remove any well borehole invasion fluid from the immediate area to enable measurement of connate formation fluid free of borehole invasion; and
(g) wherein continuous pressure is applied to said pad for sealing during sample drawing.

2. The method of claim 1 including the preliminary step of connecting a sample line to a snorkel and also connecting first and second separately operable expandable means to the sample line to enable pressure reduction to be operably and selectively done on the sample line coupled to the snorkel.

3. The method of claim 1 including the preliminary step of extending a backup shoe against the wall of the formation opposite the snorkel, and sustaining the backup shoe under continuous fluid pressure until completion of the flow test.

4. The method of claim 3 wherein the formation testing tool includes upper and lower backup shoes and including the step of extending the upper and lower backup shoes against the wall of the formation, wherein continuous fluid pressure is maintained on the backup shoes until completion of formation testing.

5. The method of claim 4 wherein the formation testing tool supports the backup shoes on two similar piston powered rods and including the step of extending the two similar piston powered rods supporting the backup shoes from a sonde in one direction, and simultaneously extending a snorkel from the sonde in the opposite direction.

6. The method of claim 5 including the step of applying hydraulic pressure to power the pistons and simultaneously applying hydraulic pressure to a piston powered seal around the snorkel and sustaining hydraulic pressure until formation testing is completed.

7. The method of claim 6 including the step of opening a control valve means so long as hydraulic pressure is applied to the pistons, and then closing the control valve to end hydraulic pressure application.

8. A formation testing tool for measuring the pressure within a formation penetrated by a well borehole comprising:

(a) sample drawing means having a snorkel and locatable within the well borehole for establishing, through the wall of the well borehole and isolated from pressures within the well borehole, a snorkel-ended direct fluid flow path communicating with an adjacent formation;
(b) fluid drawing means coupled with said sample drawing means for drawing fluid from the adjacent formation;
(c) seal means sealing around said snorkel to substantially remove the well borehole pressure from the immediate area of the snorkel-ended direct fluid flow path to enable formation fluid to define pressure acting on said sample drawing means; and
(d) means for continuously loading said seal means during operation of said fluid drawing means to prevent formation invasion by well borehole fluid.

9. The apparatus of claim 8 wherein said loading means comprises:

(a) a cylinder enclosing a piston connected with a piston rod for extension of said seal means during said operation;
(b) a hydraulic fluid supply circuit connected to deliver hydraulic fluid for moving said piston; and
(c) control valve means in said circuit for controlling the application of hydraulic pressure to provide loading on said seal means, and wherein said control valve means operates so long as said seal means requires loading, said hydraulic circuit further extending said seal means to establish an initial seal against the well borehole wall.

10. The apparatus of claim 8 further including:

(a) a hydraulic cylinder having a double acting piston therein with an extending piston rod;
(b) backup shoe supported on said piston rod for movement and contact with the wall of the borehole; and
(c) means for supporting said backup shoe for movement opposite the snorkel.

11. The apparatus of claim 10 including two similar backup shoes, wherein one of said backup shoes is located above and opposite said snorkel and the second of said backup shoes is located below and opposite said snorkel.

12. The apparatus of claim 11 including control valve means connected in a hydraulic fluid supply circuit to operate so long as said backup shoes are contacted against the wall, said valve means holding high pressure on said piston for extending said backup shoes.

* * * * *